United States Patent [19]

Langlois

[11] 4,228,665

[45] Oct. 21, 1980

[54] APPARATUS FOR TERRYING YARN

[75] Inventor: Marius Langlois, Waterloo, Canada

[73] Assignee: Burlington Industries, Inc., Greensboro, N.C.

[21] Appl. No.: 967,496

[22] Filed: Dec. 7, 1978

Related U.S. Application Data

[63] Continuation-in-part of Ser. No. 878,724, Feb. 17, 1978, abandoned.

[51] Int. Cl.[2] ..... D04B 9/12; D04B 15/02

[52] U.S. Cl. ..... 66/93; 66/95

[58] Field of Search ..... 66/9 R, 92, 93, 95, 66/107

[56] References Cited

U.S. PATENT DOCUMENTS

| | | | |
|---|---|---|---|
| 1,506,427 | 8/1924 | Howie | 66/95 X |
| 1,838,739 | 12/1931 | Breaithwaite | 66/9 R |
| 2,091,638 | 8/1937 | Jacques et al. | 66/95 X |
| 3,107,509 | 10/1963 | Farmer | 66/93 X |
| 3,879,962 | 4/1975 | Mahler | 66/92 X |
| 4,010,626 | 3/1977 | Feher | 66/93 |

FOREIGN PATENT DOCUMENTS

| | | | |
|---|---|---|---|
| 1273725 | 9/1961 | France | 66/93 |
| 46-15141 | 4/1971 | Japan | 66/93 |
| 849710 | 9/1960 | United Kingdom | 66/93 |

*Primary Examiner*—Wm. Carter Reynolds
*Attorney, Agent, or Firm*—Cushman, Darby & Cushman

[57] ABSTRACT

A circular ladies hosiery knitting machine is provided having a conventional rotatable needle cylinder and dial. The dial includes radially movable transfer jacks which, when fully extended, cooperate with the needles to form loops on the jacks. A selectively operable device positions a de-looper element in the path of loops carried by the transfer jacks whereby the loops are lifted out of engagement with the jacks without the jacks having to be retracted.

3 Claims, 3 Drawing Figures

APPARATUS FOR TERRYING YARN

This application is a continuation-in-part of application Ser. No. 878,724, filed Feb. 17, 1978, now abandoned.

BACKGROUND OF THE INVENTION

The present invention relates to an improvement in circular ladies hosiery knitting machinery adapted to simultaneously knit yarn and introduce terry to the knitted product.

Techniques and equipment for terrying a fabric produced by circular knitting machines are well known. Examples of such arrangements are those disclosed in U.S. Pat. Nos. 3,107,509, issued to Glen R. Farmer on Oct. 22, 1963 and 4,010,626, which was granted to Tibor Feher on Mar. 8, 1977.

In each of the two patents just identified, a rotatable dial is employed which is coaxial with, and operatively related to, a rotatable needle cylinder. The cylinder houses needles which are arranged for up-and-down motion as the cylinder rotates. The reciprocating needles engage yarn so as to knit the fabric. The dial supports a plurality of radially arranged loop-forming elements which are selectively extended to a position proximate the path of reciprocation of the needles whereby during downward movement of the needles, a length of yarn is engaged and is drawn into engagement with the elements. Continued downward needle movement results in loops of yarn being formed. The elements are configured such that upon their retraction into the dial, the loops are released, thereby forming terry in the knitted fabric.

During fabrication of a product such as a pantyhose with knitted waistband, it is also desirable to form loops which are knitted directly into the fabric rather than serving as terry. This requires that a previously formed loop be positioned in the path of needle movement so that the loop is engaged by the needle and drawn into the next course of fabric being knitted.

Such a procedure is not possible with terrying arrangements of the type disclosed, for example, in U.S. Pat. No. 3,107,509 inasmuch as the verge bit has essentially a smooth, straight upper surface. Once a loop is formed and the verge bit is withdrawn prior to be re-extended for introduction of the loop to the next course, the verge bit withdrawal results in the loop slipping off the end of the verge bit.

One of the embodiments disclosed in U.S. Pat. No. 4,010,626 attempts to solve this problem by utilizing a pair of loop-forming elements having been modified, one with the tip completely cut off and the other one, the tip modified. When terry is to be formed, full retraction of the pairs of loop-forming elements into the dial causes the loop to be removed from the jacks. With such an arrangement, the loop-forming element can only do terrying, it cannot do the job of a regular transfer jack making a knitted waistband on ladies pantyhose.

It is apparent that the arrangement of U.S. Pat. No. 4,010,626 described in the preceding paragraph has important shortcomings. For example, such a device requires a pair of loop-forming elements and complicated camming is necessary to provide both partial and full withdrawal of the loop-forming elements.

SUMMARY OF THE INVENTION

The present invention provides a simplified arrangement which permits terry loops to be formed without any modification of conventional transfer jacks and without the necessity of providing means for selectively obtaining partial and complete withdrawal of the transfer jacks. More particularly, a de-looper is provided which is selectively moved into the path of loops formed on extended transfer jacks to lift the loops therefrom when terrying is desired. In the case where it is desired that the loops formed by the transfer jacks be knitted into a subsequent course of fabric, the de-looper is removed from the path of travel of the loops. The transfer jacks then can be withdrawn and re-extended without the loops carried by the jacks being lost. This permits the loops to be knitted into a subsequent course of the fabric. When this operation is completed, the transfer jacks can be cleared for terrying by moving the de-looper into the path of the travel of the loops.

With the arrangement just described, it is possible to double knit a waistband in a ladies pantyhose and then transfer to conventional knitting. This results from the fact that the basic knitting machine's transfer jacks are not altered as in the case of the loop-forming elements and verge bits disclosed in U.S. Pat. Nos. 4,010,626 and 3,107,509, respectively.

DETAILED DESCRIPTION OF THE INVENTION

The invention now will be described in further detail with reference to the accompanying drawings wherein.

Figure 1:
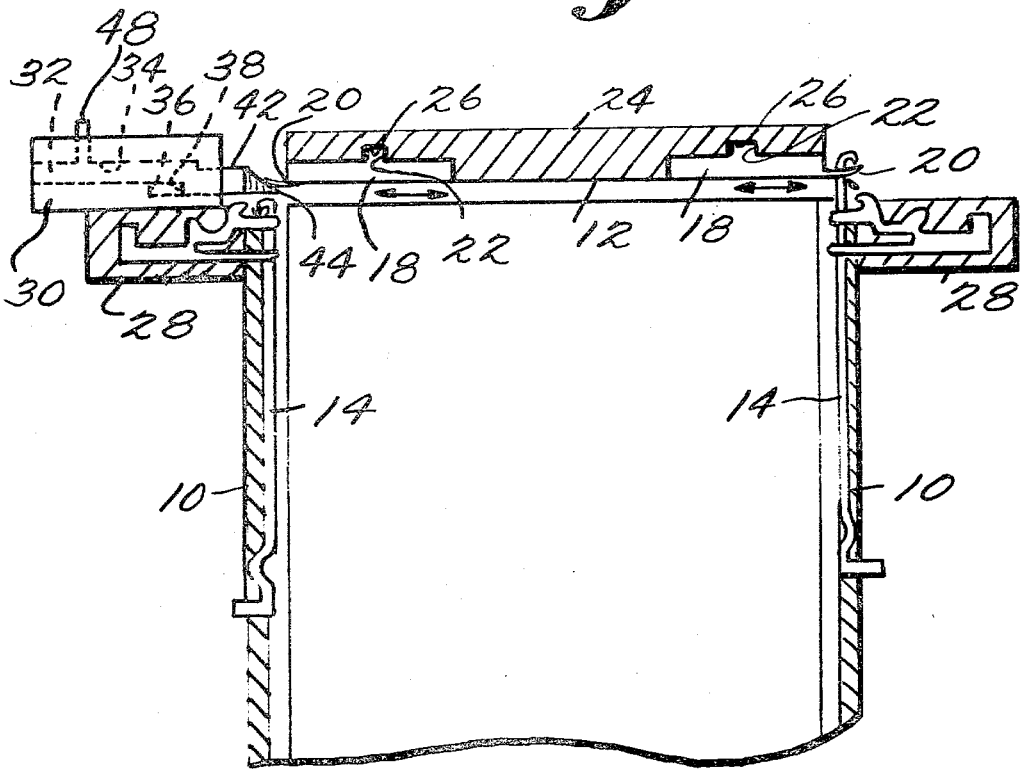
FIG. 1 is an elevational view, partially in section, illustrating portions of a circular ladies hosiery knitting machine incoporating a de-looper according to the present invention.
Figure 2:
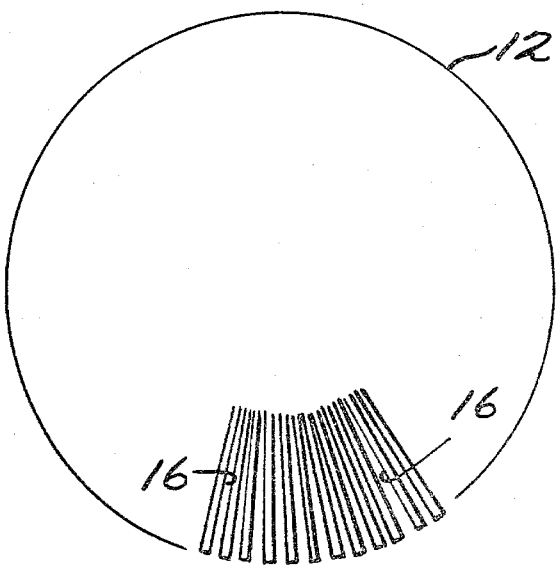
FIG. 2 is a top plan of a dial element shown in FIG. 1.

Referring first to FIGS. 1 and 2, portions of a conventional circular ladies hosiery knitting machine are illustrated. A typical machine with which the present invention may be used is the Mark IV model produced by Textile Machine Works of Wyomissing, Pennsylvania, the successor of which is North American Rockwell Corporation of Pittsburgh, Pennsylvania. However, it will be apparent that the invention can be utilized on any type of ladies hosiery knitting machine. For convenience of illustration, only those portions of the machine necessary to explain the operation of the invention have been shown.

The circular knitting machine includes a needle cylinder 10 and a dial 12. These elements are operatively related to rotate simultaneously about the axis of the cylinder.

The needle cylinder carries conventional latch-type knitting needles 14 which are vertically reciprocated in accordance with a cam system (not shown) in order to engage yarn and knit the fabric. Since the manner of feeding yarn and performing the necessary steps to achieve a knit are well known, the structure required for this operation has been omitted from the drawings.

The rotatable dial 12 includes a plurality of radially extending slots 16 only a few of which are shown in FIG. 2. The slots 16 receive respective conventional transfer jacks 18 which can be seen in FIG. 1. Each jack includes at one end thereof a curved tip 20 which projects beyond dial 12, and a vertically extending projection 22 is provided intermediate the ends of the jack.

A stationary dial cap 24 is positioned above the dial 12. Cap 24 includes a groove 26 which receives the projections 22 of the jacks. The groove 26 is formed in a configuration such that as the dial 12 rotates with respect to cap 24, the transfer jack projections 22 follow the groove to cause the jacks to move within their slots in a plane normal to the direction of movement of needles 14. When the jacks are fully extended in this manner, their tips 20 are positioned in operative relationship with needles 14. More particularly, each extended jack tip is located in a space between a pair of associated needles whereby when the latter are elevated above the transfer jack to catch yarn and then are lowered past the jack, the yarn carried by the needles is brought into engagement with the corresponding jack tip to form a loop.

A rotatable sinker bed assembly with a stationary cap 28 is positioned below dial 12 and is positioned in operative relationship with the needles 14 at a location outside the cylindrical space defined by the array of needles. The sinker assembly supports a number of elements employed in the knitting operation. However, since such elements are conventional, they have only been generally illustrated, and no discussion thereof is necessary. The stationary cap of the sinker bed assembly 28 additionally supports a de-looper arrangement. This de-looper includes a stationary block 30 and a sliding block assembly 32 operatively related to block 30. More particularly, block 30 includes a longitudinally extending channel 34 formed with a shoulder portion 36. Block assembly 32 is provided with a longitudinally extending projecting portion 38 formed to be slidably received within channel 34. Outward movement of assembly 32 is limited by the engagement of portion 38 with shoulder 36.

Figure 3:
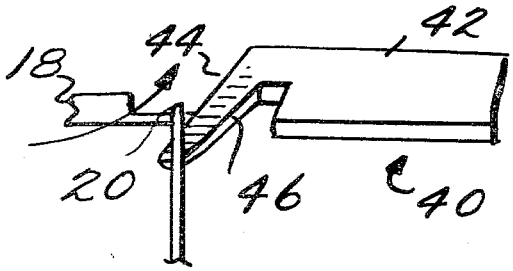
FIG. 3 is a diagrammatic view illustrating a de-looping operation utilizing the structure shown in FIG. 1.

The block assembly 32 includes a de-looper element 40 having an arm portion 42 which projects beyond block 30. As can be appreciated from FIG. 3, an upwardly inclined loop-engaging portion 44 is provided at the projecting end of arm 42. Portion 44 includes a curved edge surface 46 which is configured so as to be able to lift a loop from a transfer jack when such a loop is brought into engagement with edge 46 and the arm 42 is fully extended, as shown in FIG. 1. The loop-lifting operation itself can be understood by reference to FIG. 3.

When the arm 42 is retracted to the point where portion 38 engages shoulder 36, portion 44 of the de-looper is positioned outside the loci of movement of the vertically reciprocating needles and beyond the maximum extension of the tips 20 of the transfer jacks. Consequently, no interference with the de-looper can occur as the needles and jacks move with respect to the stationary de-looper.

During those periods when loops are formed on the transfer jacks in the manner previously described, the elevation of the needle and extension of the transfer jacks are programmed such that the loops are produced at a location angularly displaced from the fixed position of the de-looper 40. When it is desired to form terry from the loops, the transfer jacks remain extended after the loops are formed thereon, and the arm 42 of the de-looper 40 is extended prior to the arrival of the loops at the de-looping position. The de-looper may be extended and withdrawn in a variety of ways. For example, this operation may be accomplished by selectively energizing a solenoid (not shown) which is joined to a projecting element 48 secured to block assembly 32 whereby solenoid actuation is translated through element 48 to sliding movement of the assembly with respect to block 30.

When the de-looper arm 42 is fully extended, edge 46 of the inclined portion 44 describes a path from a position below and inwardly of the circular locus of the extended transfer jack tip 20 to a position above and outwardly of this locus. The edge 46 has a directional component extending in the direction of movement of the transfer jack as the latter moves past the de-looper. Consequently, as can be appreciated from FIG. 3, the loops carried by the extended transfer jacks are lifted and separated from the tips 20 by edge 46 as the jack passes over the de-looper. Thus, terrying is accomplished without withdrawing the transfer jacks as is required by the arrangements disclosed in U.S. Pat. Nos. 3,107,509 and 4,010,626. The jacks remain extended to produce loops on the next course(s) of fabric whereby a terry patch is knitted. The terrying operation is terminated by withdrawal of the de-looper arm 42.

In the case where the loops formed on the transfer jacks are to be knitted into a subsequent course of the item being produced, the jacks are retracted. The curved tips 20 of the jacks permit the loops to be retained by the jacks until the jacks again are extended into operative relationship with knitting needles.

What is claimed is:

1. An apparatus for terrying yarn comprising:

a circular ladies hosiery knitting machine including:

(a) a latch needle cylinder and a dial rotatable about a common axis;

(b) a plurality of latch needles supported by said cylinder and movable therewith as the cylinder rotates, said needles being adapted to be reciprocated in a direction parallel to said axis to knit yarn into a fabric; and (c) a plurality of transfer jacks radially oriented with respect to said dial and movable therewith as the dial rotates, said jacks being adapted to be extended and retracted with respect to the dial in a plane normal to the direction of reciprocation of said needles, said jacks, when extended, cooperating with the needles to form loops of yarn on the jacks, said loops being movable in a circular path as the jacks rotate with the dial; and a de-looping arrangement adapted to be moved between operative and inoperative positions, said arrangement in the operative position being located in the path of movement of the loops carried by said extended jacks thereby engaging said loops to separate them from the jacks and said arrangement in the inoperative position being located out of the path of movement of the loops carried by said extended jacks thereby permitting said loops to be knitted into the fabric.

2. An apparatus according to claim 1 wherein said de-looping arrangement is mounted on a stationary support, said arrangement including a slidable block assembly joined to the support and a de-looping element extending from said assembly, said element being provided with an inclined portion for engaging and elevating the loops when said de-looping arrangement is in its operative position and the transfer jacks are extended.

3. An apparatus according to claim 2, wherein said inclined portion has a loop-engaging edge having a directional component extending in the direction of movement of the transfer jacks as they move past said element.

* * * * *